US006674989B1

(12) United States Patent
Kusaba et al.

(10) Patent No.: US 6,674,989 B1
(45) Date of Patent: Jan. 6, 2004

(54) ENDLESS BELT WITH SERPENTINE MOTION PREVENTING MEMBER AND IMAGE FORMING APPARATUS INCLUDING SAME

(75) Inventors: Takashi Kusaba, Sunto-gun (JP); Akihiko Nakazawa, Sunto-gun (JP); Akira Shimada, Sunto-gun (JP); Tsunenori Ashibe, Yokohama (JP); Hidekazu Matsuda, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/722,548

(22) Filed: Nov. 28, 2000

Related U.S. Application Data

(63) Continuation of application No. PCT/JP00/07364, filed on Oct. 23, 2000.

(30) Foreign Application Priority Data

Oct. 22, 1999 (JP) ..... 11-301675

(51) Int. Cl.[7] ..... G03G 15/16
(52) U.S. Cl. ..... 399/302; 399/308
(58) Field of Search ..... 399/302, 308, 399/303, 313, 312

(56) References Cited

U.S. PATENT DOCUMENTS 5,369,477 A * 11/1994 Foote et al.
5,765,077 A * 6/1998 Sakura et al. ..... 399/176
5,842,080 A 11/1998 Ashibe et al.
5,995,794 A 11/1999 Osada et al.
6,038,415 A * 3/2000 Nishi et al. ..... 399/111
6,141,522 A * 10/2000 Tsuruoka et al. ..... 399/302
6,184,470 B1 * 2/2001 Froehlich et al. ..... 174/77
6,192,210 B1 * 2/2001 Munenori et al. ..... 399/165

FOREIGN PATENT DOCUMENTS

JP 08-99706 4/1996
JP 9-114266 A * 5/1997
JP 2000337464 * 12/2000

* cited by examiner

*Primary Examiner*—Quana M. Grainger
(74) *Attorney, Agent, or Firm*—Fitzpatrick, Cella, Harper & Scinto

(57) ABSTRACT

A transfer belt having a long service life and an image forming apparatus provided with the belt are provided. A serpentine motion preventing member (6*b*,) provided on at least one side portion of an inner circumferential surface of an endless belt body (6*a*, 61*a*) on which a toner image formed on an image bearing member is transferred on an outer circumference and retained by a retainer groove (R1) formed on a roller serpentine motion preventing member (6*b*, 61*b*) away from the belt body (6*a*, 61*a*). Accordingly, damage to the belt body (6*a*, 61*a*) is prevented.

11 Claims, 5 Drawing Sheets

ENDLESS BELT WITH SERPENTINE MOTION PREVENTING MEMBER AND IMAGE FORMING APPARATUS INCLUDING SAME

This application is a continuation of International Application No. PCT/JP00/07364, filed Oct. 23, 2000, which claims the benefit of Japanese Patent Application No. 11-301675, filed Oct. 22, 1999.

TECHNICAL FIELD

The present invention relates to a belt and an image forming apparatus with the belt, and more particularly relates to a serpentine motion preventing member provided in an inner circumferential surface of an endless belt.

BACKGROUND ART

In a conventional image forming apparatus such as an electrophotographic apparatus, an endless belt is used as a belt-shaped like photosensitive member, an intermediate transfer belt, a transfer belt, a paper delivery belt, a fixing belt or the like.

In this case, in general, such an endless belt is supported by two or more rollers and rotationally driven while being subjected to a desired tension. However, since there is slight variation or error in circularity or straightness of the supporting rollers, parallelism of an axis of each roller, or circularity of the endless belt per se or the like, there are cases where the belt would be subjected to a serpentine motion to the right and left. Then, in the case where such an endless belt is used as a transfer belt such as a full color electrophotographic apparatus that needs high precision, the image forming position of each color would be displaced from others upon the color superimposition on the transfer belt, resulting in color misregister due to the serpentine motion of the transfer belt.

Therefore, in order to prevent such a serpentine motion, the serpentine motion preventing member is provided over the full circumferential inner surface of the transfer belt and at the same time, grooves are formed on the rollers around which the transfer belt is laid. The rollers are rotated while the serpentine motion preventing member is retained by the grooves whereby the transfer belt is smoothly traveled without any serpentine motion of the transfer belt, and thus, it is possible to form an excellent image without any color misregister.

However, there are some cases where the serpentine motion preventing member is peeled off from the transfer belt and in an extreme case, a crack would occur in the transfer belt due to a stress caused by the deformation of the serpentine motion preventing member with the rollers or the like.

For this reason, as in, for example, JP-A-08099706, an acrylic foamed material is used as a belt reinforcement base member, and a polyurethane sheet with a limited hardness is adhered thereto to thereby exhibit a stress moderating effect and a serpentine motion preventing effect to the belt.

However, in the case of such a structure, since a large portion of a thickness of the serpentine motion preventing member is occupied by the nonfoamed material, the serpentine motion preventing member is largely deformed at the bent portion of the belt, and the endless belt is subjected to a large stress. Accordingly, in case of use for a long period of time, there is a case that the serpentine motion preventing member would be peeled off.

Then, this phenomenon is remarkable in the case where a diameter of the rollers around which the transfer belt is laid is small and a contact angle of the transfer belt to the rollers is large. Namely, in order to meet the service life of the transfer belt, it is necessary to increase the diameter of the rollers around which the transfer belt is laid and to decrease the contact angle of the transfer belt to the rollers, i.e., to provide the rollers in a multiplicity of axes. This becomes a remarkable obstacle against the miniaturization of the image forming apparatus.

DISCLOSURE OF THE INVENTION

Accordingly, in view of such a current situation, an object of the present invention is to provide a belt having a long service life and an image forming apparatus provided with this belt.

According to the present invention, an endless belt stretched around a plurality of rollers is characterized by having: a serpentine motion preventing member provided on at least one side portion of an inner circumferential surface of the belt body and retained by the rollers, wherein the serpentine motion preventing member is formed of foamed material.

Also, according to the present invention, the serpentine motion preventing member is retained by a retainer groove formed in the rollers.

Also, according to the present invention, the serpentine motion preventing member is retained at a side end of the rollers.

Also, according to the present invention, an average foam diameter of the foamed material is 10 $\mu$m or more and 300 $\mu$m or less.

Also, according to the present invention, a void rate of the foamed material is 20% or more and 80% or less.

Also, according to the present invention, a surface layer having a void rate that is smaller than that of other portions is formed on at least one of a surface in contact with the rollers and a surface bonded to the belt body of the foamed material.

Also, according to the present invention, the void rate of the surface layer is less than 20%.

Also, according to the present invention, the thickness of the surface layer is 100 $\mu$m or less.

Also, according to the present invention, the belt body is a seamless belt.

Also, according to the present invention, an image forming apparatus having an image bearing member and an intermediate transfer belt on which a toner image formed on the image bearing member is to be transferred and wherein the toner image on the intermediate transfer belt is to be transferred to the transfer material, the above-described intermediate transfer belt is any of the belt described above.

Also, according to the present invention, an image forming apparatus having an image bearing member and a transfer delivery belt which bears the transfer material on which a toner image formed on the image bearing member is to be transferred, the above-described transfer belt is any one of the belts described above.

With such an arrangement according to the present invention, the serpentine motion preventing member provided on at least one side portion of an inner circumferential surface of the endless belt body on which the toner image formed on the image bearing member on an outer circumferential surface is transferred and retained by the retainer groove formed in the rollers is formed of foamed material whereby the peel of the serpentine motion preventing member away from the belt body and the damage of the belt body may be prevented.

BEST MODE FOR CARRYING OUT THE INVENTION

A mode for embodying the present invention will now be described with reference to the drawings.

Figure 1:
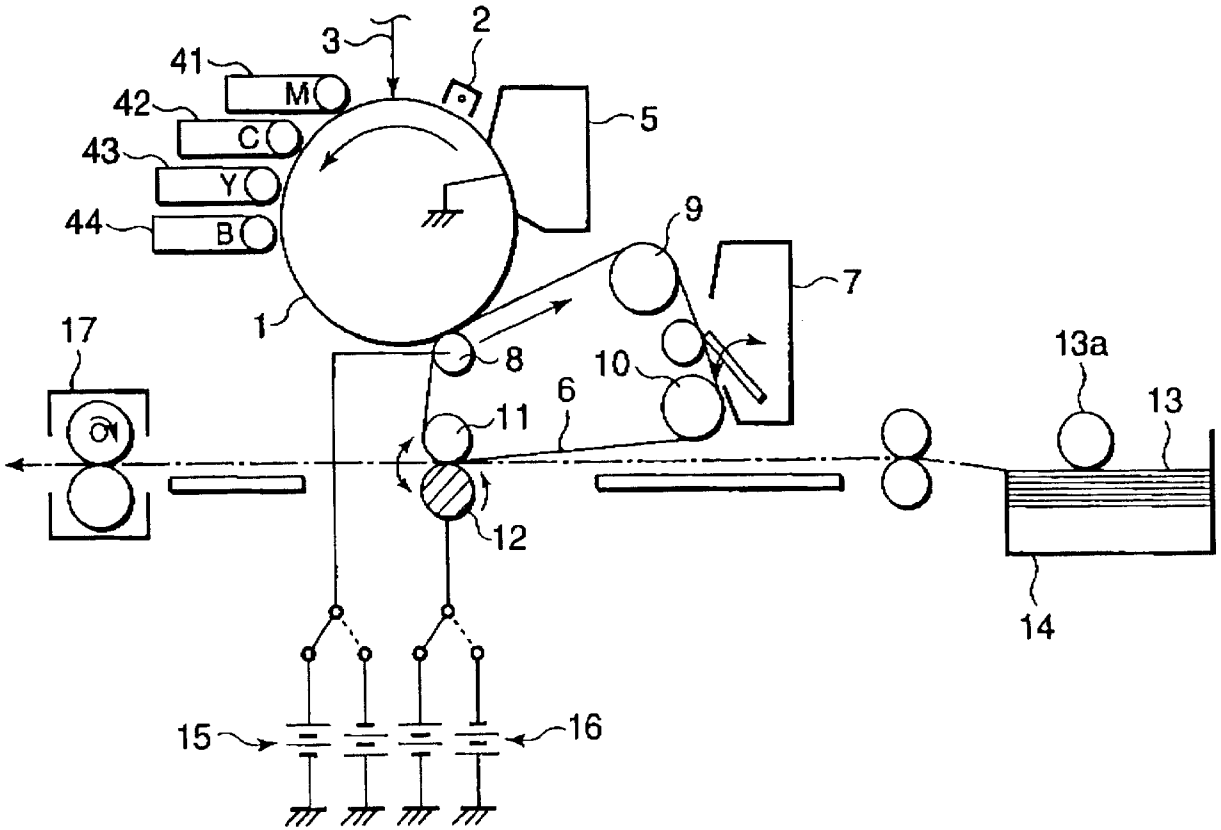
FIG. 1 is a schematic view showing an image forming apparatus using an intermediate transfer belt that is an example of a belt according to an embodiment of the present invention.

FIG. 1 is a schematic view showing a laser color printer (an image forming apparatus) using an intermediate transfer belt that is an example of a belt according to an embodiment mode of the present invention.

In this drawing, a numeral 1 denotes a drum-shaped electrophotographic photosensitive member (hereinafter referred to as a photosensitive drum) as a first image bearing member, which is rotationally driven at a predetermined peripheral speed (process speed) in a direction indicated by an arrow.

Also, a numeral 2 denotes a corona charger for uniformly charging and processing the surface of the photosensitive drum 1 to a predetermined polarity and potential, and numerals 41 to 44 denote developing devices for developing electrostatic latent images, formed on the photosensitive drum by receiving exposure 3 from image exposure means (not shown), with M (magenta), C (cyan), Y (yellow) and B (black) toner, respectively. Incidentally, a color separation/imaging exposure optical system of a color original, a scanning exposure optical system by a laser scanner for outputting a laser beam modulated corresponding to an electrical digital image signal on the time series of the image information or the like is used as the image exposure means.

Also, a numeral 6 denotes an intermediate transfer belt. A numeral 8 denotes a primary transfer roller that is rotated while urging the intermediate transfer belt 6 against the photosensitive drum 1. The toner image formed and borne on the photosensitive drum 1 is transferred onto the outer circumferential surface of the intermediate transfer belt 6 and by an electric field and pressure formed by a primary transfer bias having the opposite polarity to that of the toner applied from a power source 15 to the primary transfer roller 8 during a process where the intermediate transfer belt 6 is passed while being urged against the photosensitive drum 1.

Incidentally, this intermediate transfer belt 6 is laid around a drive roller 9, a tension roller 10, a secondary transfer opposite roller 11 and the primary transfer roller 8, and is adapted to be rotationally driven at a predetermined peripheral speed in a direction indicated by an arrow by the drive roller 9.

Also, a numeral 12 denotes a secondary transfer roller that is in contact with the intermediate transfer roller 6. The full color image transferred onto the intermediate transfer belt 6 is transferred to a transfer material 13 by a secondary transfer bias applied from a bias power source 16 to the secondary transfer roller 12 when the transfer material 13 that is a second bearing member fed from a paper feed cassette 14 by a pickup roller 13*a* or the like at a predetermined timing is passed through a contact nip between the intermediate transfer belt 6 and the secondary transfer roller 12.

Also, a numeral 17 denotes a fixing device for heating and fixing the transferred toner image, to the transfer material 13. A numeral 7 denotes an intermediate transfer belt cleaning member for cleaning off the transfer residual toner remaining on the intermediate transfer belt 6 after transferring the image to the transfer material 13. A numeral 5 denotes a cleaning member for the photosensitive drum 1.

The image forming operation of the image forming apparatus with such a structure will now be described.

Upon the formation of the image, first of all, the surface of the photosensitive drum 1 is charged and processed to the predetermined polarity and potential by the corona charger 2 in the rotational process of the photosensitive drum 1. Subsequently, an electrostatic latent image corresponding to a first color component (for example, an image of magenta component) of the desired color image is formed on the surface of the photosensitive drum 1 by the exposure 3 from the image exposure means (not shown).

Subsequently, the electrostatic latent image is developed by the first developing device 41 (magenta developing device). Thereafter, the magenta toner image of a first color formed and borne on this photosensitive drum 1 is transferred primarily on the outer circumferential surface of the intermediate transfer belt 6 rotationally driven in pressure contact with the photosensitive drum 1 at the predetermined peripheral speed in the direction indicated by the arrow, by the primary transfer bias applied from the power source 15 to the primary transfer roller 8.

Hereinafter, in the same manner, the cyan toner image of a second color, the yellow toner image of a third color and the black toner image of a fourth color are superimposed and transferred onto the intermediate transfer belt 6 in order, whereby a target full color image is formed. Incidentally, in the primary transfer process, the secondary transfer roller 12 and the intermediate transfer belt cleaning member 7 are separated away from the intermediate transfer belt 6.

Subsequently, the full color image superimposed and transferred onto the intermediate transfer belt 6 is transferred onto the transfer material 13 passing through the contact nip between the transfer belt 6 and the secondary transfer roller 12 and fed from the paper feed cassette 14 at the predetermined timing by the secondary transfer bias applied from the bias power source 16 to the secondary roller 12 already kept in contact with the intermediate transfer belt 6 at this time.

Then, the transfer material 13 onto which the toner image is thus transferred secondarily is introduced into the fixing device 17 and the toner image is heated and fixed onto the transfer material 13 in the fixing device 17. Incidentally, after the completion of the image transfer to the transfer material 13, the transfer residual toner remaining on the intermediate transfer belt 6 is removed by the intermediate transfer belt cleaning member 7 already kept in contact with the intermediate transfer belt 6 at this time.

Figure 2:
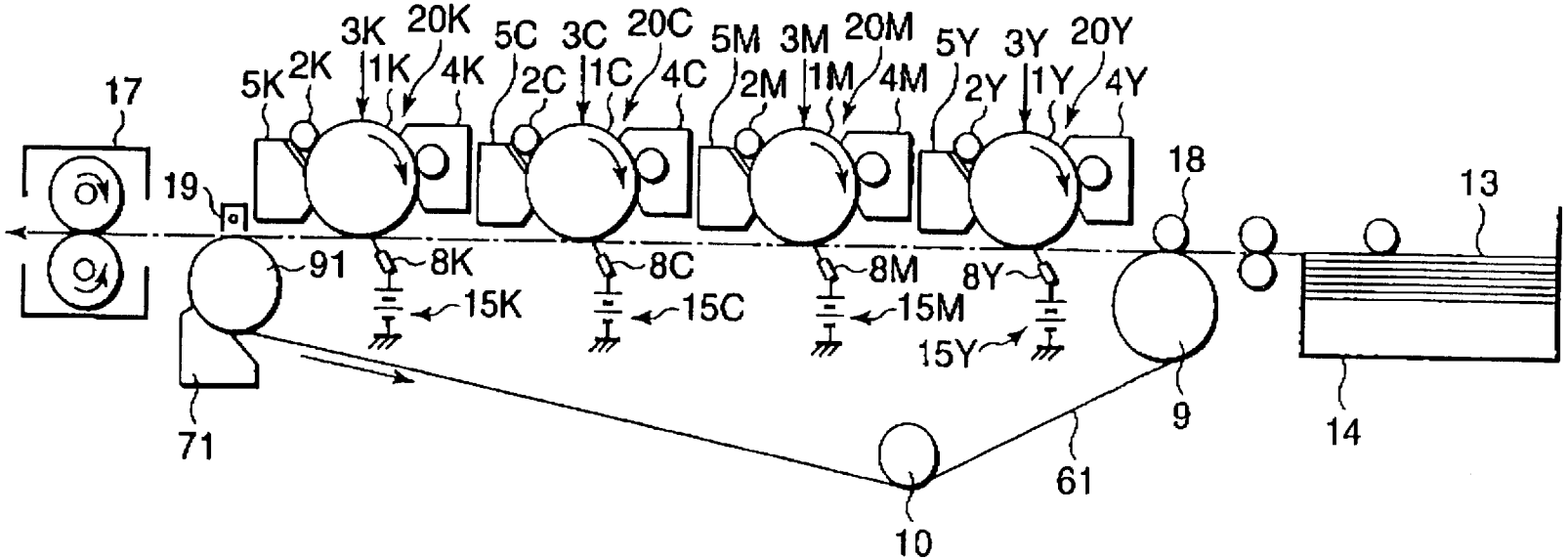
FIG. 2 is a schematic view showing an image forming apparatus using a transfer delivery belt that is an example of a belt according to an embodiment of the present invention.

On the other hand, FIG. 2 is a schematic view showing an image forming apparatus using a transfer delivery belt that is an example of a belt according to an embodiment of the present invention. Incidentally, in the same drawing, the same reference numerals of FIG. 1 are used to indicate the same or like components or members. Also, this image forming apparatus is a tandem type laser color printer in which image forming stations are arranged for a plurality of colors (for example, yellow, magenta, cyan and black).

In the same drawing, 20Y, 20M, 20C and 20K are the first to the fourth image forming stations. These image forming stations 20Y, 20M, 20C and 20K are provided with photosensitive drums 1Y, 1M, 1C and 1K each rotationally driven at a predetermined peripheral speed (process speed) in a direction indicated by an arrow, primary charging rollers 2Y, 2M, 2C and 2K for uniformly charging and processing each surface of the photosensitive drum 1Y, 1M, 1C and 1K to predetermined polarity and potential, and developing devices 4Y, 4M, 4C and 4K each for developing the electrostatic latent image formed on the photosensitive drum receiving the exposure 3Y, 3M, 3C and 3K by the image exposure means (not shown) by the toner of Y, M, C, B, respectively.

Also, a numeral 61 denotes a transfer delivery belt stretched around a drive roller 9 and a driven roller 91 and rotationally driven at a predetermined peripheral speed in a direction indicated by an arrow. Characters 8Y, 8M, 8C and 8K denote transfer sheets. The toner image formed and carried on the photosensitive drums 1Y, 1M, 1C and 1K is made to be transferred to the transfer material 13 by the transfer bias applied from bias power sources 15Y, 15M, 15C and 15K to the transfer sheets 8Y, 8M, 8C and 8K in the process where the transfer material 13 passes through the nip portions between the photosensitive drums 1Y, 1M, 1C and 1K and the transfer belt 61.

Also, a numeral 18 denotes a suction roller to which a predetermined suction bias is applied for suction of the transfer material 13 to the transfer delivery belt 61. A numeral 19 denotes a separator charger for applying a separation bias for separating the transfer material 13 away from the transfer delivery belt 61.

The image forming operation of the image forming apparatus with such a structure will now be described.

Upon the formation of an image, first of all, the surface of the photosensitive drum 1Y of the first image forming station 20Y is charged and processed uniformly at predetermined polarity and potential by the primary charging roller 2Y in the rotational process of the photosensitive drum 1Y. Subsequently, the electrostatic latent image corresponding to the first color component (yellow) of the target color image is formed on the surface of the photosensitive drum 1Y by the exposure 3Y from the image exposure means (not shown) as the exposure process.

Subsequently, the electrostatic latent image is developed by the first developing device 4Y (yellow developing device) as the developing process. Thereafter, as the transfer process, the yellow toner image of the first color formed and borne on this photosensitive drum 1Y is transferred electrostatically to the transfer material 13 by the transfer bias applied from the bias power source 15Y to the transfer sheet 8Y when the transfer material 13 moving and borne on the transfer delivery belt 61 rotationally driven at the predetermined peripheral speed in the direction indicated by the arrow by the drive roller 9 passes through the contact nip between the photosensitive drum 1Y and the transfer delivery belt 61, after the transfer material is fed from the paper feed cassette 14 at the predetermined timing. Incidentally, to sum up, in order for the transfer delivery belt 61 to suck the transfer material 13, the predetermined suction bias is applied to the suction roller 18.

Subsequently, the residual toner that has not been transferred from the photosensitive drum 1Y to the transfer material 13 is removed by the photosensitive drum cleaner 5Y as the cleaning process. Hereinbelow, the respective image forming processes of the above-described charging, exposure, development, transfer and cleaning are repeated.

Furthermore, also, in the second through fourth image forming stations 20M, 20C and 20K, the image forming process similar to the first image forming station 20Y is effected at the predetermined timing whereby the yellow, magenta, cyan and black toner is superimposed and transferred onto the transfer material 13 to form the target full color image.

Thereafter, the transfer material 13 on which the toner image has been transferred is separated from the transfer delivery belt 61, and thereafter is introduced into the fixing device 17. The toner image is heated and fixed to the transfer material 13 in this fixing device 17. Furthermore, after the completion of the image transfer to the transfer material 13, paper powder, toner or the like on the transfer delivery belt 61 is removed by the belt cleaning member 71. Incidentally, the separator charger 19 may be used when the transfer material 13 is separated from the transfer delivery belt 61.

By the way, the intermediate transfer belt 6 and the transfer delivery belt 61 (hereinafter collectively referred to as an intermediate transfer belt or the like) that need high precision in regard to the serpentine motion has endless belt bodies 6*a*, 61*a* having the outer circumferential surfaces to which the toner image is transferred and serpentine motion preventing members 6*b*, 61*b* provided on one end portion or both end portions of the inner circumferential surfaces of the belt bodies 6*a*, 61*a* as shown in (*a*) through (*c*) of FIG. 3.

By the way, since the intermediate transfer belt 6 or the like is stretched between two or more rollers (see FIGS. 1 and 2) and rotationally driven, with just the serpentine motion preventing members 6*b*, 61*b* arranged, the serpentine motion preventing members 6*b*, 61*b* may be peeled off the belt bodies 6*a*, 61*a* or in an extreme case, a crack occurs in the belt bodies 6*a*, 61*a* due to a stress caused by the deformation of the serpentine motion preventing members 6*b*, 61*b* at the roller portion as described above.

Therefore, in this embodiment, a foamed material is used as the serpentine motion preventing members 6*b*, 61*b*. Then, by using the foamed material, the serpentine motion preventing members 6*b*, 61*b* may follow the deformation at the roller portion or the like. Thus, it is possible to reduce the stress applied to the serpentine motion preventing members 6*b*, 61*b*, and it is possible to prevent the damage of the belt bodies 6*a*, 61*a* and the separation of the serpentine motion preventing members 6*b*, 61*b* from the belt bodies 6*a*, 61*a*.

Here it is preferable that the average foam diameter of the foamed material be 10 $\mu$m or more and 300 $\mu$m or less. Incidentally, if the average foam diameter is less than 10 $\mu$m, the serpentine motion preventing members 6*b*, 61*b* may hardly follow the deformation so that the peel from the belt bodies 6*a*, 61*a* becomes likely. If the average foam diameter exceeds 300 $\mu$m, the true straightness of the serpentine motion preventing members 6*b*, 61*b* is lowered so that the serpentine motion preventing effect is degraded in some cases.

Also, it is preferable that the void rate of the foamed material be 20% or more and 80% or less. Incidentally, if the void rate is less than 20%, if the serpentine motion preventing members 6*b*, 61*b* may hardly follow the deformation, the peel from the belt bodies 6*a,* 61*a* becomes likely. If the void rate exceeds 80%, the rigidity of the serpentine notion preventing members 6*b,* 61*b* is lowered so that the serpentine motion preventing effect is degraded in some cases.

Figure 3:
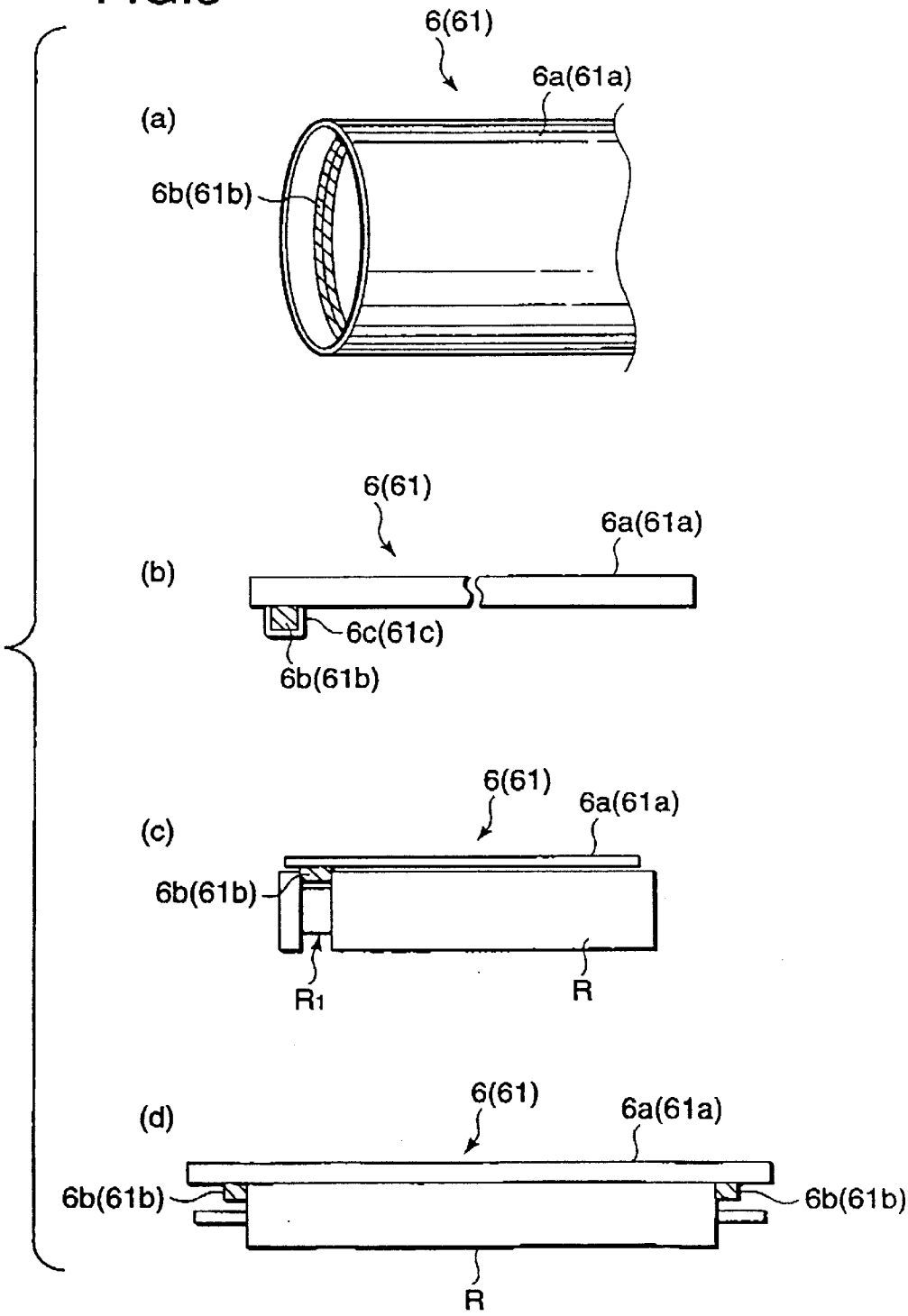
FIG. 3 is a view showing a structure of the above-described belt (the intermediate transfer belt and the transfer delivery belt).

As shown in (*b*) of FIG. 3, it is preferable that skin layers 6*c,* 61*c* where the void rate is clearly lower than that of other portions are provided at least one of a surface along which the serpentine motion preventing members 6*b,* 61*b* and the belt bodies 6*a,* 61*a* are contacted and a surface along which the serpentine motion preventing members 6*b,* 61*b* and the roller members are contacted, i.e., at least one of the surface of the foamed material in contact with the belt bodies 6*a,* 61*a* and the surface thereof in contact with the roller.

Then, such skin layers 6*c,* 61*c* are thus provided whereby it is possible to enhance the bonding strength in the case where the serpentine motion preventing members 6*b,* 61*b* and the belt bodies 6*a,* 61*a* are bonded (adhered, stuck, etc.) to each other. Also, the slidability between the serpentine motion preventing member 6*b,* 61*b* and the roller is enhanced to thereby enhance the serpentine motion preventing effect.

Here, such an effect is considerably exhibited in the case where the void rate of the skin layers 6*c,* 61*c* is less than 20%. Also, it is preferable that the thickness of the skin layers 6*c,* 61*c* be 100 μm or less. Incidentally, if the thickness of the skin layers exceeds 100 μm, the flexibility of the serpentine motion preventing members 6*b,* 61*b* is lowered so that the members may hardly follow the deformation. As a result, the peel from the belt bodies 6*a,* 61*a* becomes likely.

Also, it is preferable that the belt bodies 6*a,* 61*a* having the serpentine motion preventing members 6*b,* 61*b* be seamless belts which have no seam. Then, without having a seam the nonuniformity of the thickness may be reduced. The stress concentration to the belt bodies 6*a,* 61*a* by the bend at the roller portion may be suppressed. Accordingly, it is possible to further elongate the service life of the belt bodies 6*a,* 61*a.*

By the way, there is no special limitation to the material of the foamed material constituting the serpentine motion preventing members 6*b,* 61*b* and any kind of well known foamed material may be used. However, in view of the fact that the compression permanent strain is small and it is possible to adhere the material to the belt bodies 6*a,* 61*a* with various adhesives or sticky materials, it is preferable to use urethane group foamed material or acrylic foamed material.

Also, a cross-sectional shape of the serpentine motion preventing members 6*b,* 61*b* is such a cross-sectional sectional shape that the serpentine motion preventing members are retained in a groove R1 formed in the outer circumferential surface of the roller R tensioning the intermediate transfer belt 6 or the like for preventing the serpentine motion as shown in (*c*) of FIG. 3. In general, the cross-sectional shape is a square shape or a rectangular shape for the reason of easiness of machining or the like. More specifically, it is preferable to adapt a square shape or a rectangular shape having a width in the range of 1 to 5 mm and a thickness in the range of 0.3 to 0.5 mm. However, it is not limited to these ranges.

Incidentally, in the embodiment, the case where the serpentine motion preventing members 6*b,* 61*b* are retained in the groove R1 for preventing the serpentine motion formed in the outer circumferential surface of the roller R is described. It is, however, possible to retain the serpentine motion preventing members 6*b,* 61*b* on the side end of the roller R as shown in (*d*) of FIG. 3. Then, even in such a case, it is preferable that the cross-sectional shape of the serpentine motion preventing members 6*b,* 61*b* be that described above.

On the other hand, if the belt bodies 6*a,* 61*a* having flexibility is in the form of a belt, it is possible to use a film-like shape, a mesh-like shape or the like and it Is not specifically limited. Also, the material therefor may be selected from a variety of material such as thermosetting resin, thermoplastic resin, metal, rubber. In particular, in view of the easiness of moldings, the cost or the like, it is preferable to be formed of the thermoplastic resin.

More specifically, one or more may be selected from polyethylene (high density, medium density, low density, straight chain low density or the like), polypropylene, polystyrene, ethylene-vinyl alcohol copolymer (EVOH), polycarbonate, polyamide, polyacetal, polyarylate, polyphenylene ether, denatured polyphenylene ether, polyimide, liquid crystal polymer, polysulfone, polyether sulfone, polyphenylene sulfite, polyvis-amide triazole, polyetherimide, polyamideimide, polyether etherketone, aliphatic polyketone, polymethyl pentene, polybutylene terephthalate, polyethylene telephthalate, polyethylene naphthalate, polyvinyl fluoride, polyvinylidene fluoride (PVdF), chlorotrifluoroethlene, ethylene tetrafluorovinylidene copolymer (ETFE), hexafluoropropylene, perfluoroalkyl vinyl ether copolymer, methacryl resin, and other various coplymers.

In particular, although not limited thereto, in view of the mechanical characteristics and moldability of the belt, it is preferable to select polycarbonate, polyvinylidene fluoride (PVdF), polysulfone, polyimide, polyphenylene sulfide, polyarylate and ethylene tetrafluoroethylene copolymer (ETFE).

Also, for the purpose of imparting the conductivity to these resins, it is possible to add, for example, various conductive agents such as carbon black for example such as acetylene black, furnace black and channel black, titanium oxide, potassium titanate, tin oxide, lithium salt, fourth ammonium salt or the like.

Furthermore, there is no problem at all even if filling agents such as talc, mica, calcium carbonate, nonflammable agents such as magnesium hydroxide and antimony trioxide, and additives such as oxidation preventing agent (phenols, sulfurs, or the like) are used. Of course, the additives are not limited thereto but it is possible to use any other additives as desired.

Here as a method to add the additives to the above-described resin, it is possible to take a method for kneading and dispersing them by using a well known kneader such as a mono-axial extruder, a biaxial extruder, a Bunbury mixer, a roller, a kneader or the like. In general, each component is molded after the component is in the form of pellets by kneading by an extruder or the like. In a particular case, each component may be fed directly to a molding machine to mold the material while kneading in the molding machine.

On the other hand, it is possible to adopt a conventional method such as a centrifugal molding method, a continuous melting extruding method, an injection molding method, a blow molding method, an inflation film forming method or the like. However, it is preferable to adopt the continuous melting extruding method or the inflation molding method in view of the manufacture in low cost. Incidentally, the endless belt thus molded may be subjected to the operation such as drawing.

Here it is preferable that the thickness of the belt bodies 6*a,* 61*a* be 50 μm or more and 1,000 μm or less, and more preferably 100 μm or more and 700 μm or less. Incidentally, if it is less than 50 μm, the belt bodies 6*a,* 61*a* is likely to expand, whereas if it exceeds 1,000 μm, it is difficult to obtain flexible deformation so that the drive at the uniform speed by the small diameter rollers is impossible, resulting in the enlargement of the apparatus.

Furthermore, the belt bodies 6*a,* 61*a* may be formed of a single layer or may be formed of a plurality of layers. Also, if the belt bodies formed of the plurality of layers is to be obtained, it is possible to extrude thermoplastic resin material formed of a plurality of layers in advance from a plurality of dies, or it is possible to obtain a tubular film made of a single layer from the thermoplastic resin material formed of a single layer, and thereafter to provide a new layer on a top surface or a back surface of the single endless belt by spraying or dipping coating material for example to obtain the belt bodies 6*a,* 61*a* made of the plurality of layers.

On the other hand, there is no special limitation to the bonding method of the serpentine motion preventing members 6*b,* 61*b* and the belt bodies 6*a,* 61*a* and a well known method of bonding (adhering, sticking) may be used. However, in view of the easiness to handle and the bonding strength, it is preferable to use a pressure sensitive adhesive double coated tape having an acrylic adhesive.

Also, for the purpose of enhancing the bonding strength of the belt bodies 6*a,* 61*a* and the serpentine motion preventing members 6*b,* 61*b* or the reinforcement, it is possible to provide a strip-shaped member (not shown) at the end portion of the belt bodies 6*a,* 61*a*. Incidentally, it is possible to use a variety of material as the material for this strip-shaped member but it is preferable to use PET (polyethylene terephthalate) tape because of the reinforcing effect of the belt, the easiness of handling, or the like.

Furthermore, for the purpose of enhancing the bonding strength of the belt bodies 6*a,* 61*a* and the serpentine motion preventing members 6*b,* 61*b,* it is possible to apply a variety of surface processings such as corona charging on a joint surface of the belt bodies 6*a,* 61*a* and the serpentine motion preventing members 6*b,* 61*b*.

Subsequently, a method of measuring the average foam diameter of the foamed material and the void rate will be described.

Upon the measurement, first of all, the serpentine motion preventing members 6*b,* 61*b* are cut at any desired position by using a sharp knife (razor or the like) such that the foam (cells) is (are) not crashed.

Subsequently, the foamed material is viewed on an enlarged scale by using a microscope (an optical microscope, a scanning electronic microscope or the like) to count the number of cells N per any measurement range S ($\mu m^2$) and to measure the diameter R (μm) of the respective cells. Here, in the case where the shape of the cells is unstable, the outer circumference is measured and the cell shape is presumed as a circle having the outer circumference that is equivalent to the actually measured contour to adopt it as the diameter of the cells. The magnification or the measurement range may be selected to facilitate the measurement in view of the size of the cells or the like. However, the measurement range is set such that the number of the cells to be counted is fifty or more.

$$\text{Average Foam Diameter } R_{ave}[\mu m]=(R_1+R_2+R_3+\ldots+R_{N-2}+R_{N-1}+R_N)/N$$

Where $R_1$ to $R_N$ are the respective diameters (μm) of the counted cells.

$$\text{Void Rate } [\%]=[\{\pi(R_{ave}/2)^2\times N\}/S]\times 100$$

Also, the measurement of the void rate in the skin layer is obtained from the above formula by using the number of the cells existing in any desired 1 mm square of the skin layer surface and the average foam diameter. Incidentally, the thickness thereof is obtained by measuring the foamed material surface cut as described above on an enlarged scale by using the microscope (optical microscope, scanning electronic microscope or the like).

Embodiments of the present invention will now be described.

EMBODIMENT 1

Producing Endless Belt

The following three kinds of materials were blended.

| | |
|---|---|
| polycarbonate resin | 100 parts by weight |
| carbon black | 15 parts by weight |
| oxidization preventing agent | 0.5 parts by weight |

The above blended three kinds of materials were kneaded by means of a biaxial extruding kneader so that additives such as the carbon black were dispersed uniformly into a binder to obtain molding material. Furthermore, after this had been used as the kneaded material having a particle size of 1 to 2 mm, this was cast into a hopper of the mono-axial extruder, and the temperature was adjusted in the range of 270 to 290° C. to thereby obtain molten material.

Subsequently, this molten material was led to cylindrical single layer extruder dies having a diameter of 100 mm and a die gap 900 μm. Thereafter, air was blown through an air introduction passage to enlarge and expand the molten material to obtain a final dimension of a diameter of 140 mm and a thickness of 150 μm. Further, this was cut at a belt width of 250 mm to obtain a seamless belt.

On the other hand, a reinforcement tape made of polyethylene terephthalate resin was used as reinforcement members that were bonded to both end portions of the inner circumferential surface of the seamless belt to obtain the seamless belt having the reinforcement members in its inner circumferential surface.

Bonding Serpentine Motion Preventing Member to Endless Belt

A polyurethane foamed material having a rectangular shape in cross-section with a thickness of 2 mm and a width 3 mm and skin layers on four sides of the cross-section was bonded on the reinforcement member inner circumferential surface of the thus obtained seamless belt with a double coated tape with acrylic adhesives to thereby obtain an endless belt having the serpentine motion preventing member. Here, the thickness of the skin layer was about 3 μm and the void rate thereof was 10%. Also, the average foam diameter of the foamed material was 50 μm and the void rate thereof was 50%.

Then, the thus obtained endless belt having the serpentine motion preventing member was assembled as an intermediate transfer belt 6 of a color laser printer having the structure shown in FIG. 1. A durability test of 10,000 pieces of full color paper corresponding to 40,000 revolutions of the intermediate transfer belt 6 was conducted. As a result, there were no defects such as peels of the serpentine motion preventing member and cracks or voids at the belt end portions. This had the sufficient durability. Also, the amount of color misregister was good at about 50 μm on average.

Figure 4:
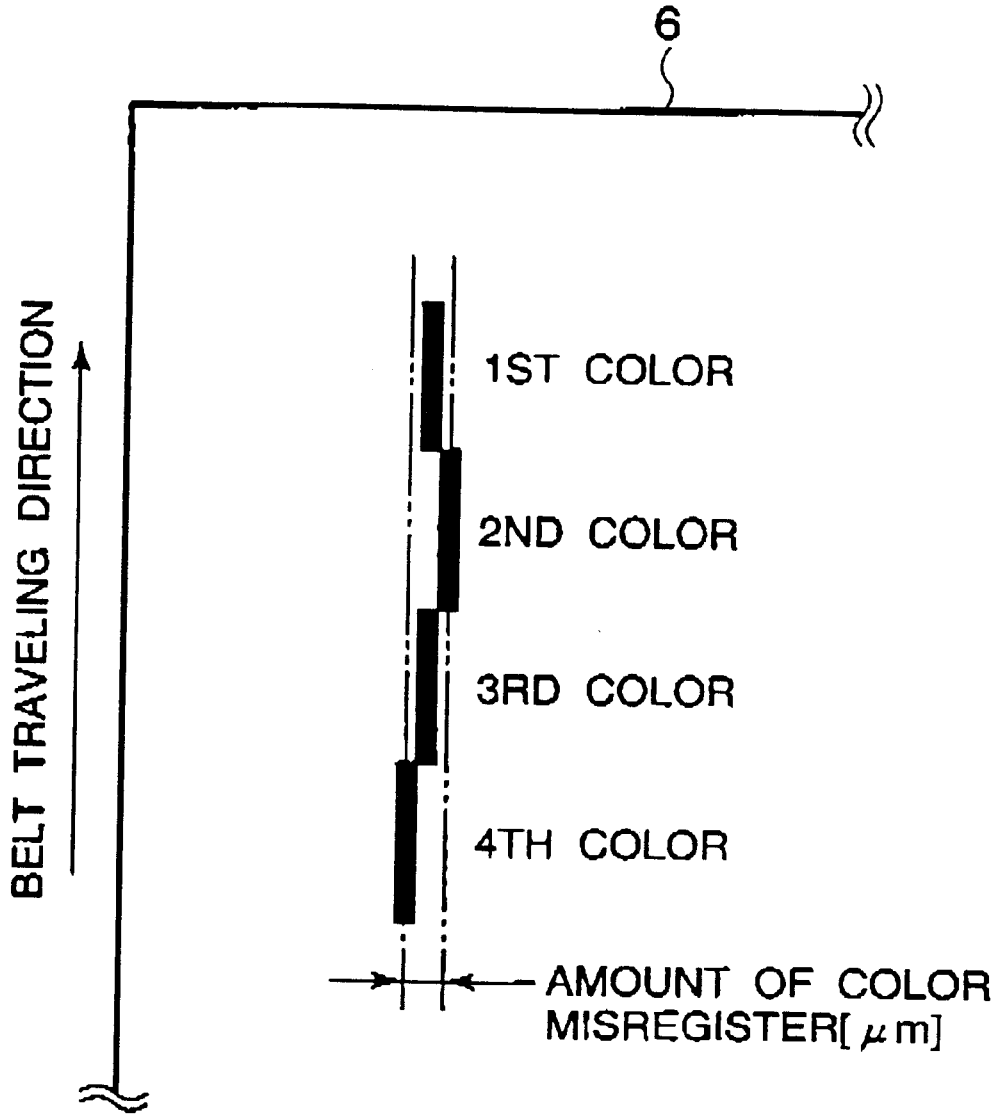
FIG. 4 is a view illustrative of the method of finding the color misregister in the above-described belt (the intermediate transfer belt and the transfer delivery belt).

Incidentally, the average value of the amount of the color misregister was obtained by outputting the line Image as shown in FIG. 4 (image having the line width of 20 μm or less) and measuring and averaging hundred of samples between two colors that had the largest amount of the color misregistration.

Furthermore, comparing the bonding strength of the serpentine motion preventing member to the endless belt through the durability test with the bonding strength of the serpentine motion preventing member to the endless belt having the serpentine motion preventing member that had been produced in the same way but had not been subjected to the durability test, the bonding strength of the test belt was about 90% of the non-tested belt. Here, in the bonding strength measurement of the belt, the peeling strength at 90° was measured and used as the bonding strength.

Figure 5:
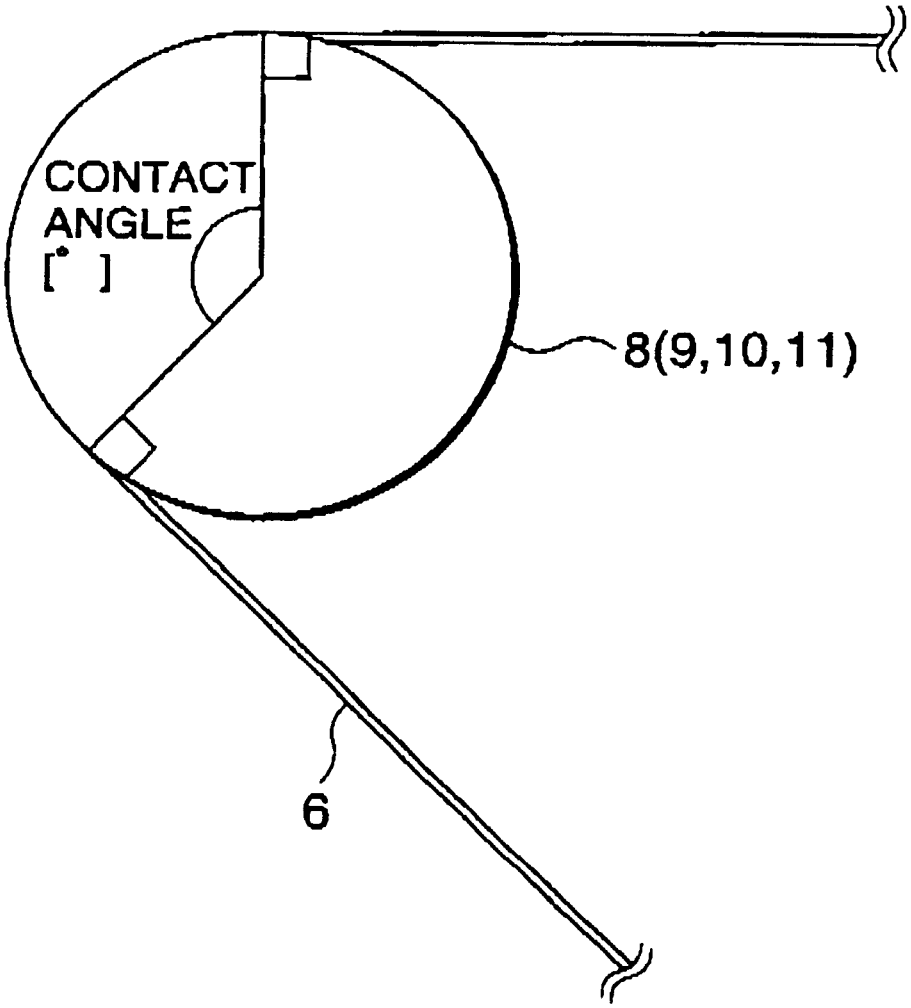
FIG. 5 is a view showing a contact angle of the above-described belt (the intermediate transfer belt and the transfer delivery belt) to the rollers.

Also, in FIG. 1, the diameters of respective rollers 8, 9, 10 and 11 tensioning the intermediate transfer belt 6 and the contact angles of the intermediate transfer belt 6 to the respective rollers 8, 9, 10 and 11 were as follows. Incidentally, the contact angle is shown in FIG. 5. Also, the intermediate transfer belt 6 was stretched at the total pressure 49N by the tension roller 10.

| | Diameter | Contact angle |
|---|---|---|
| primary transfer roller 8 | 25 mm | 50° |
| secondary transfer opposite roller 11 | 25 mm | 110° |
| tension roller 10 | 30 mm | 100° |
| drive roller 9 | 30 mm | 100° |

Even if thus, the diameters of the respective rollers 8, 9, 10 and 11 were small and the contact angles were large, the serpentine motion preventing member was made of the foamed material whereby it was possible to prevent the peel of the serpentine motion preventing member and the damage of the belt.

EMBODIMENT 2

Producing Endless Belt

The three kinds of material were blended as follows:

| | |
|---|---|
| polycarbonate resin | 100 parts by weight |
| carbon black | 12 parts by weight |
| oxidization preventing agent | 0.5 parts by weight |

The above blended three kinds of materials were kneaded by means of a biaxial extruding kneader so that additives such as the carbon black were dispersed uniformly into a binder to obtain molding material. Furthermore, after this had been used as the kneaded material having a particle size of 1 to 2 mm, this was cast into a hopper of the mono-axial extruder, and the temperature was adjusted in the range of 270 to 290° C. to thereby obtain molten material.

Subsequently, this molten material was led to cylindrical single layer extruder dies having a diameter of 200 mm and a die gap 900 μm. Thereafter, air was blown through an air introduction passage to enlarge and expand the molten material to obtain a final dimension of a diameter of 250 mm and a thickness of 150 μm. This was cut at a belt width of 350 mm to obtain a seamless belt.

On the other hand, a reinforcement tape made of polyethylene terephthalate resin was used as reinforcement members that were bonded to both end portions of the outer circumferential surface of the seamless belt to obtain the seamless belt having the reinforcement members in its outer circumferential surface.

Bonding Serpentine Motion Preventing Member to Endless Belt

The serpentine motion preventing member that is substantially the same as that of Embodiment 1 was bonded to the inner circumferential surface of the endless belt having the reinforcement members thus obtained with a double coated tape having acrylic adhesives to obtain an endless belt having the serpentine motion preventing member.

The thus obtained endless belt having the serpentine motion preventing member was assembled as an intermediate transfer belt 61 of a color laser printer having the structure shown in FIG. 2. A durability test of 100,000 pieces of full color paper corresponding to 40,000 revolutions of the intermediate transfer belt 61 was conducted. As a result, there were no defects such as peels of the serpentine motion preventing member and cracks or voids at the belt end portions. This had the sufficient durability. Also, the amount of color misregister was good at about 50 μm on average.

Furthermore, comparing the bonding strength of the serpentine motion preventing member to the endless belt through the durability test with the bonding strength of the serpentine motion preventing member to the endless belt having the serpentine motion preventing member that had been produced in the same way but had not been subjected to the durability test, the bonding strength of the test belt was about 80% of the non-tested belt. Here, in the bonding strength measurement of the belt, the peeling strength at 90° was measured and used as the bonding strength.

Also, in FIG. 2, the diameters of respective rollers 9, 91 and 10 tensioning the intermediate transfer belt 61 and the contact angles of the intermediate transfer belt 61 to the respective rollers were as follows. Also, the intermediate transfer belt 61 was stretched at the total pressure 68.6 N by the tension roller 10.

| | Diameter | Contact angle |
|---|---|---|
| drive roller 9 | 35 mm | 150° |
| driven roller 91 | 30 mm | 165° |
| tension roller 10 | 20 mm | 45° |

Even if thus, the diameters of the respective rollers 9, 10 and 91 were small and the contact angles were large, the serpentine motion preventing member was made of the foamed material whereby it was possible to prevent the peel of the serpentine motion preventing member and the damage of the belt.

EMBODIMENT 3

Producing Endless Belt

A seamless belt having a reinforcement member on the inner circumferential surface was obtained in substantially the same method as that of Embodiment 1.

Bonding Serpentine Motion Preventing Member to Endless Belt

A polyurethane foamed material having a rectangular shape in cross-section with a thickness of 2 mm and a width 3 mm and skin layers on four sides of the cross-section was bonded on the reinforcement member inner circumferential surface of the thus obtained seamless belt with a double coated tape with acrylic adhesives to thereby obtain the endless belt having the serpentine motion preventing member. Here, the thickness of the skin layer was 2 μm and the void rate thereof was 8%. Also, the average foam diameter of the foamed material was 12 μm and the void rate thereof was 25%.

Then, the thus obtained endless belt having the serpentine motion preventing member was assembled as an intermediate transfer belt 6 of a color laser printer having the structure shown in FIG. 1. A durability test of 10,000 pieces of full color paper corresponding to 40,000 revolutions of the intermediate transfer belt 6 was conducted. As a result, there were no defects such as peels of the serpentine motion preventing member and cracks or voids at the belt end portions. This had the sufficient durability. Also, the amount of color misregister was good at about 40 μm on average.

Furthermore, comparing the bonding strength of the serpentine motion preventing member to the endless belt through the durability test with the bonding strength of the serpentine motion preventing member to the endless belt having the serpentine motion preventing member that had been produced in the same way but had not been subjected to the durability test, the bonding strength of the test belt was about 50% of the non-tested belt. Here, in the bonding strength measurement of the belt, the peel strength at 90° was measured and used as the bonding strength.

EMBODIMENT 4

Producing Endless Belt

A seamless belt having a reinforcement member on the inner circumferential surface was obtained in substantially the same method as that of Embodiment 1.

Bonding Serpentine Motion Preventing Member to Endless Belt

A polyurethane foamed material having a rectangular shape in cross-section with a thickness of 2 mm and a width 3 mm and skin layers on four sides of the cross-section was bonded on the reinforcement member inner circumferential surface of the thus obtained seamless belt with a double coated tape with acrylic adhesives to thereby obtain the endless belt having the serpentine motion preventing member. Here, the thickness of the skin layer was 8 μm and the void rate thereof was 25%. Also, the average foam diameter of the foamed material was 270 μm and the void rate thereof was 70%.

Then, the thus obtained endless belt having the serpentine motion preventing member was assembled as an intermediate transfer belt 6 of a color laser printer having the structure shown in FIG. 1. A durability test of 10,000 pieces of full color paper corresponding to 40,000 revolutions of the intermediate transfer belt 6 was conducted. As a result, there were no defects such as peels of the serpentine motion preventing member and cracks or voids at the belt end portions. This had the sufficient durability. Also, the amount of color misregister was good at about 90 μm on average.

Furthermore, comparing the bonding strength of the serpentine motion preventing member to the endless belt through the durability test with the bonding strength of the serpentine motion preventing member to the endless belt having the serpentine motion preventing member that had been produced In the same way but had not been subjected to the durability test, the bonding strength of the test belt was about 90% of the non-tested belt. Here, in the bonding strength measurement of the belt, the peel strength at 90° was measured and used as the bonding strength.

EMBODIMENT 5

Producing Endless Belt

A seamless belt having a reinforcement member on the inner circumferential surface was obtained in substantially the same method as that of Embodiment 1.

Bonding Serpentine Motion Preventing Member t Endless Belt

A polyurethane foamed material having a rectangular shape in cross-section with a thickness of 2 mm and a width 3 mm and no skin layers was bonded on the reinforcement member inner circumferential surface of the thus obtained seamless belt with a double coated tape with acrylic adhesives to thereby obtain the endless belt having the serpentine motion preventing member. Here, the average foam diameter of the foamed material was 50 μm and the void rate thereof was 50%.

Then, the thus obtained endless belt having the serpentine motion preventing member was assembled as an intermediate transfer belt 6 of a color laser printer having the structure shown in FIG. 1. A durability test of 10,000 pieces of full color paper corresponding to 40,000 revolutions of the intermediate transfer belt 6 was conducted. As a result, there were no defects such as peels of the serpentine motion preventing member and cracks or voids at the belt end portions. This had the sufficient durability. Also, the amount of color misregister was good at about 80 μm on average.

Furthermore, comparing the bonding strength of the serpentine motion preventing member to the endless belt through the durability test with the bonding strength of the serpentine motion preventing member to the endless belt having the serpentine motion preventing member that had been produced in the same way but had not been subjected to the durability test, the bonding strength of the test belt was about 75% of the non-tested belt. Here, in the bonding strength measurement of the belt, the peel strength at 90° was measured and used as the bonding strength.

EMBODIMENT 6

Producing Endless Belt

A seamless belt having a reinforcement member on the inner circumferential surface was obtained in substantially the same method as that of Embodiment 1.

Bonding Serpentine Motion Preventing Member to Endless Belt

A polyurethane foamed material having a rectangular shape in cross-section with a thickness of 2 mm and a width 3 mm and skin layers on four sides of the cross-section was bonded on the reinforcement member inner circumferential surface of the thus obtained seamless belt with a double coated tape with acrylic adhesives to thereby obtain the endless belt having the serpentine motion preventing member. Here, the thickness of the skin layer was 1 μm and the void rate thereof was 5%. Also, the average foam diameter of the foamed material was 10 μm and the void rate thereof was 15%.

Then, the thus obtained endless belt having the serpentine motion preventing member was assembled as an intermediate transfer belt 6 of a color laser printer having the structure shown in FIG. 1. A durability test of 10,000 pieces of full color paper corresponding to 40,000 revolutions of the intermediate transfer belt 6 was conducted. As a result, there were no defects such as peels of the serpentine motion preventing member and cracks or voids at the belt end portions. This had the sufficient durability. Also, the amount of color misregister was good at about 40 μm on average.

Furthermore, comparing the bonding strength of the serpentine motion preventing member to the endless belt through the durability test with the bonding strength of the serpentine motion preventing member to the endless belt having the serpentine motion preventing member that had been produced in the same way but had not been subjected to the durability test, the bonding strength of the test belt was about 30% of the non-tested belt. Here, in the bonding strength measurement of the belt, the peel strength at 90° was measured and used as the bonding strength.

EMBODIMENT 7

Producing Endless Belt

A seamless belt having a reinforcement member on the inner circumferential surface was obtained in substantially the same method as that of Embodiment 1.

Bonding Serpentine Motion Preventing Member to Endless Belt

A polyurethane foamed material having a rectangular shape in cross-section with a thickness of 2 mm and a width 3 mm and no skin layers was bonded on the reinforcement material inner circumferential surface of the thus obtained seamless belt with a double coated tape with acrylic adhesives to thereby obtain the endless belt having the serpentine motion preventing member. Here, the average foam diameter of the foamed material was 330 μm and the void rate thereof was 82%.

Then, the thus obtained endless belt having the serpentine motion preventing member was assembled as an intermediate transfer belt 6 of a color laser printer having the structure shown in FIG. 1. A durability test of 10,000 pieces of full color paper corresponding to 40,000 revolutions of the intermediate transfer belt 6 was conducted. As a result, there were no defects such as peels of the serpentine motion preventing member and cracks or voids at the belt end portions. This had the sufficient durability. Also, the amount of color misregister was large at about 120 μm on average but sufficient for the practical use.

Furthermore, comparing the bonding strength of the serpentine motion preventing member to the endless belt through the durability test with the bonding strength of the serpentine motion preventing member to the endless belt having the serpentine motion preventing member that had been produced in the same way but had not been subjected to the durability test, the bonding strength of the test belt was about 90° of the non-tested belt. Here, in the bonding strength measurement of the belt, the peel strength at 90° was measured and used as the bonding strength.

Comparison examples will now be described.

Comparison Example 1

Producing Endless Belt

A seamless belt having a reinforcement member on its inner circumference was obtained through the similar method to the above-described Embodiment 1.

Then, the seamless belt having the reinforcement member was assembled as an intermediate transfer belt 6 of a color laser printer having the structure shown in FIG. 1 without providing any serpentine motion preventing member, and the full color durability test was conducted. As a result, due to the stress caused by the fact that the belt was biased in one direction of a roller due to the serpentine motion, when about fifty images were outputted, a crack occurred in the belt end portion. Thus, the durability test was stopped.

Comparison Example 2

Producing Endless Belt

A seamless belt having a reinforcement member on its outer circumference was obtained through the similar method to the above-described Embodiment 2.

Bonding Serpentine Motion Preventing Member to Endless Belt

A serpentine motion preventing member made of polyurethane elastomer in the form of a rectangular form in cross-section with a thickness 2 mm and a width of 3 mm was bonded on the inner circumferential surface of the seamless belt having the reinforcement member thus obtained with a double coated tape with acrylic adhesives to thereby obtain the endless belt having the serpentine motion preventing member.

The thus obtained endless belt having the serpentine motion preventing member was assembled as an intermediate transfer belt 61 of a color laser printer having the structure shown in FIG. 2 and the full color durability test was conducted. As a result, due to the peel of the serpentine motion preventing member when about 50,000 images were outputted (about 20,000 revolutions of the transfer delivery belt), the serpentine motion preventing member was peeled off. Then, the image forming apparatus was out of order, and the image output became impossible. Thus, the durability test was stopped. Also, at this time, visually confirming the test belt, there were many fine cracks in the belt end portion.

As described above, according to the present invention, the serpentine motion preventing member provided on at least one side portion of the inner circumferential surface of the endless belt body is formed of a foamed material to thereby make it possible to prevent the peel of the serpentine motion preventing member and the damage of the belt. Thus a belt having a long service life can be obtained. Also, in the case where the diameter of the rollers for tensioning the belt is small and the contact angle is large, it is possible to prevent the peel of the serpentine motion preventing member and the damage of the belt by forming the serpentine motion preventing member using the foamed material. Accordingly, it is possible to miniaturize the image forming apparatus.

What is claimed is:

1. A movable belt stretched around a roller, said belt comprising:

a serpentine motion preventing member provided on at least one end portion of said belt in a direction perpendicular to a movement direction of said belt in an inner circumferential surface of said belt and engaged with said roller, wherein said serpentine motion preventing member is formed in its entirety of a foamed material.

2. A belt according to claim 1, wherein said serpentine motion preventing member is engaged with a groove formed in said roller.

3. A belt according to claim 1, wherein said serpentine motion preventing member is engaged at a side end of said roller.

4. A belt according to claim 1, wherein an average foam diameter of said foamed material is 10 $\mu$m or more and 300 $\mu$m or less.

5. A belt according to claim 1, wherein a void rate of said foamed material is 20% or more and 80% or less.

6. A belt according to claim 1, wherein a surface layer having a void rate that is smaller than a void rate of other portions of said serpentine motion preventing member is formed on at least one of a surface in contact with said roller and a surface bonded to said belt of said foamed material.

7. A belt according to claim 6, wherein the void rate of said surface layer is less than 20%.

8. A belt according to claim 6, wherein a thickness of said surface layer is 100 $\mu$m or less.

9. A belt according to claim 1, wherein said belt is a seamless belt.

10. An image forming apparatus comprising:

an image bearing member; and a movable intermediate transfer belt stretched around a roller, wherein a toner image on said image bearing member is transferred onto said intermediate transfer belt, and a toner image on said intermediate transfer belt is transferred to a transfer material, wherein said intermediate transfer belt comprises a serpentine motion preventing member provided on at least one end portion of said intermediate transfer belt in a direction perpendicular to a movement direction of said intermediate transfer belt in an inner circumferential surface of said intermediate transfer belt and engaged with said roller, and wherein said serpentine motion preventing member is formed in its entirety of a foamed material.

11. An image forming apparatus comprising:

an image bearing member; and a movable transfer material delivery belt for bearing a transfer material, said transfer material delivery belt being stretched around a roller, wherein a toner image on said image bearing member is transferred onto a transfer material borne on said transfer material delivery belt, wherein said transfer material delivery belt comprises a serpentine motion preventing member provided on at least one end portion of said transfer material delivery belt in a direction perpendicular to a movement direction of said transfer material delivery belt in an inner circumferential surface of said transfer material delivery belt and engaged with said roller, and wherein said serpentine motion preventing member is formed in its entirety of a foamed material.

* * * * *

UNITED STATES PATENT AND TRADEMARK OFFICE

CERTIFICATE OF CORRECTION

PATENT NO. : 6,674,989 B1
DATED : January 6, 2004
INVENTOR(S) : Takashi Kusaba et al.

It is certified that error appears in the above-identified patent and that said Letters Patent is hereby corrected as shown below:

Title page,
Item [56], References Cited, FOREIGN PATENT DOCUMENTS, "2000337464" should read -- 2000-337464 --.

Column 6,
Line 51, "6a," should read -- 6a, --.

Column 7,
Line 50, "sec-" should be deleted; and
Line 51, "tional" should be deleted.

Column8,
Line 3, "be that described" should read -- be that as described --;
Line 7, "Is" should read -- is --; and
Line 27, "coplymers." should read -- copolymers. --.

Column 11,
Line 2, "Image" should read -- image --.

Column 12,
Line 17, "100,000 pieces" should read -- 10,000 pieces --.

UNITED STATES PATENT AND TRADEMARK OFFICE

CERTIFICATE OF CORRECTION

PATENT NO. : 6,674,989 B1
DATED : January 6, 2004
INVENTOR(S) : Takashi Kusaba et al.

It is certified that error appears in the above-identified patent and that said Letters Patent is hereby corrected as shown below:

Column 13,
Line 67, “In” should read -- in --.

Column 14,
Line 13, “t” should read -- to --.

Column 15,
Line 56, “90° of” should read -- 90% of --.

Signed and Sealed this

Twenty-ninth Day of June, 2004

JON W. DUDAS
*Acting Director of the United States Patent and Trademark Office*